US010863599B2

(12) United States Patent
Janik et al.

(10) Patent No.: US 10,863,599 B2
(45) Date of Patent: Dec. 8, 2020

(54) WHITE LIGHT TUNING

(71) Applicant: SIGNIFY HOLDING B.V., Eindhoven (NL)

(72) Inventors: Raymond George Janik, Fayetteville, GA (US); Russell Scott Trask, Sharpsburg, GA (US); Christopher Bohler, Peachtree City, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/677,300

(22) Filed: Nov. 7, 2019

(65) Prior Publication Data

US 2020/0146116 A1 May 7, 2020

Related U.S. Application Data

(60) Provisional application No. 62/757,061, filed on Nov. 7, 2018.

(51) Int. Cl.
*H05B 45/00* (2020.01)
*H05B 45/20* (2020.01)

(52) U.S. Cl.
CPC ..... *H05B 45/20* (2020.01)

(58) Field of Classification Search
CPC ..... H05B 45/00; H05B 45/10; H05B 45/20; H05B 47/00; H05B 47/10
See application file for complete search history.

(56) References Cited

U.S. PATENT DOCUMENTS 9,936,557 B1 * 4/2018 Janik ..... H05B 45/46
2017/0181241 A1 * 6/2017 Koo ..... H05B 45/22

* cited by examiner

*Primary Examiner* — Jimmy T Vu

(57) ABSTRACT

A lighting device includes a first string of light emitting diodes (LEDs) configured to emit a warm white light having a warm Correlated Color Temperature (CCT). The lighting device further includes a second string of LEDs configured to emit a cool white light having a cool CCT. The lighting device also includes green light LEDs that emit a green light. A flux of the green light is controlled based on a flux of the cool white light or a flux of the warm white light. The flux of the warm white light and the flux of the cool white light change proportionally with respect to each other.

19 Claims, 13 Drawing Sheets

WHITE LIGHT TUNING

CROSS REFERENCE TO RELATED APPLICATIONS

The present application claims priority under 35 U.S.C. Section 119(e) to U.S. Provisional Patent Application No. 62/757,061, filed Nov. 7, 2018 and titled "White Light Tuning," the entire content of which is incorporated herein by reference.

TECHNICAL FIELD

The present disclosure relates generally to lighting solutions, and more particularly to white light tuning.

BACKGROUND

In some cases, a lighting fixture may be designed such that the Correlated Color Temperature (CCT) of the light emitted by the lighting fixture is adjustable. For example, a light emitting diode (LED) light fixture may emit a warm white light (e.g. 2700-3000 K) at one setting, a cool white light (e.g., 5000 K-6000 K) at another setting or a white light with a CCT between warm and cool white lights at yet another setting. For example, white light color tuning may be accomplished by using a combination of warm white light and cool white light, resulting in a combined light with a resultant CCT that is a combination of the CCT of the warm white light and the CCT of the cool white light. On a chromaticity chart, the CCT of the combined light resulting from such a combination of lights sits on a straight line joining a CCT of the warm white light and a CCT of the cool white light. Typically, the chromaticity of the resultant white light moves away from the black-body radiation curve as the combined CCT changes from the CCT of the warm or the cool white light toward the halfway point between the warm and cool white lights. Achieving white light color tuning cost effectively and reliably while keeping the curve of the combined white light relatively close to the black-body radiation curve can be challenging. Thus, a solution that enables effective white light color tuning that results in a light that is relatively close to the black-body radiation curve is desirable.

SUMMARY

The present disclosure relates generally to lighting and location-based systems, and more particularly to lighting solutions, and more particularly to white light tuning. In an example embodiment, a lighting device includes a first string of light emitting diodes (LEDs) configured to emit a warm white light having a warm Correlated Color Temperature (CCT). The lighting device further includes a second string of LEDs configured to emit a cool white light having a cool CCT. The lighting device also includes green light LEDs that emit a green light. A flux of the green light is controlled based on a flux of the cool white light or a flux of the warm white light. The flux of the warm white light and the flux of the cool white light change proportionally with respect to each other.

In another example embodiment, a non-transitory computer-readable medium containing instructions executable by a processor. The instructions include receiving information indicating an amount of a current flow through cool light LEDs that emit a cool white light and generating an output signal to control a flux of a green light emitted by green light LEDs. An illumination light provided by a light source comprises the cool light, the green light, and a warm white light emitted by warm light LEDs. The output signal is generated based on a lookup table that includes mappings of values of the cool white light corresponding to amounts of the current flowing through the cool light LEDs to values of the flux of the green light. The values of the flux of the green light are generated based on a second degree equation that approximates a black-body radiation curve.

In yet another example embodiment, a lighting device includes a first string of light emitting diodes (LEDs) configured to emit a warm white light having a warm white Correlated Color Temperature (CCT) and a second string of LEDs configured to emit a cool white light having a cool CCT. The lighting device further includes green light LEDs configured to emit a green light and amber light LEDs configured to emit an amber light. A flux of the green light and a flux of the amber light are controlled based on a flux of the cool white light. A flux of the warm white light and the flux of the cool white light change proportionally with respect to each other.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
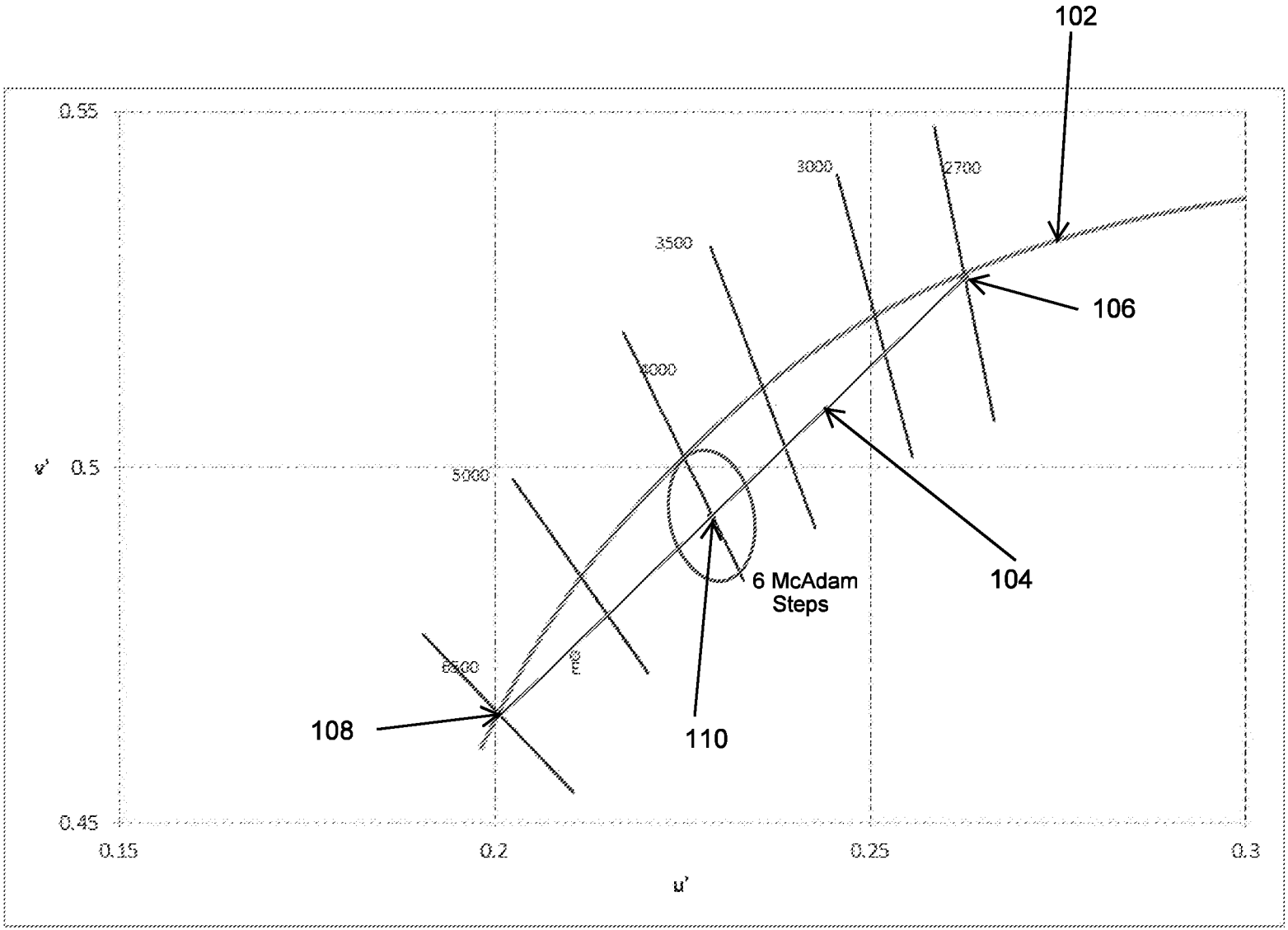
FIG. 1 illustrates a white light tuning path curve relative to the black body curve (BBC) according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in different figures designate like or corresponding, but not necessarily identical elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

White light color tuning using two white LEDs that emit lights with two different CCTs is generally desirable. However, such systems are limited in white tuning range because, as the range increases, the departure from the Black Body Curve (BBC), which is characterized by Duv or Du'v', also increases. In most cases, a 3-channel solution is adopted to reduce the undesirably high Duv at the expense of increased cost and complexity. The correction line between two CCTs, for example, 2700K and 6500K, lies below the BBC.

In some example embodiments, a simple low cost analog circuit that does not require light sensing, feedback or calibration may be used to correct the departure from the BBC in 2-channel white tuning LED light fixtures. To illustrate, in the CIE 1976 Uniform Color Space, the relationship between the correction value of the departure from the BBC and the flux ratio of two lights emitted by two LEDs can be described by a second order polynomial. By taking the current of one of the LEDs as an independent variable and applying it to an analog multiplier circuit, a second order form of the current may be generated, which can drive, for example, a green light LED that emits a green light (e.g., a phosphor converted green light). The green light can be produced as a second order response to the currents of the two white LEDs that are related to each other and will cause the resultant white light (i.e., the combination of the green light and the white lights emitted by the two LEDs) to be pulled close towards the BBC. In some example embodiments, the solution may enable tracking the BBC anywhere between two CCTs, even as far as 2700K to 6500K. In some example embodiments, the solution may enable tracking the BBC anywhere between two CCTs, such as, for example, 1500K to 7000K, by including, for example, an amber LED along with the green light led, and adjusting the ratio of the green and amber lights, resulting in a moving correction light, to correct the chromaticity of the resultant of the lights at the two ends such as, for example, 1500K and 7000K.

Turning now to the figures, particular example embodiments are described. FIG. 1 illustrates a white light tuning path curve 104 relative to the black-body curve (BBC) 102 according to an example embodiment. In some example embodiments, a light source of a lighting fixture may include a warm LED (which may include multiple LEDs) that emits a warm white light having a CCT of, for example, 2700K. The light source may also include a cool LED (which may include multiple LEDs) that emits a cool white light having a CCT of, for example, 6500K. In FIG. 1, when a total current provided to the light source is directed to just the warm light LED (i.e., the cool white light is off), the CCT of the combined light provided by the light source may correspond to a data point 106 in the CIE 1976 Uniform Color Space of FIG. 1, where the cool white light does not contribute to the combined white light. When the total current provided to the light source is directed to just the cool light LED (i.e., the warm white light is off), the CCT of the combined light provided by the light source may correspond to a data point 108 in FIG. 1, where the warm white light does not contribute to the combined light.

When a typical white light tuning is performed by adjusting the flux contributions of the warm light and the cool light to the combined light, the characteristic of the combined light may follow the white light tuning path curve 104 in the absence of a correction for the departure of the white light tuning path curve 104 from the BBC 102. For example, the adjustment of the flux contributions of the warm light and the cool light to the combined light may be performed by changing the distribution of the total current among the warm and cool light LEDs. To illustrate starting at the data point 106 where the CCT of the combined light matches the CCT of the warm white light, the CCT of the combined light is adjusted along the white light tuning path curve 104 as an increasing portion of the total current is directed away from the warm white LED to the cool white LED. When the total current is provided to the cool white LED at the data point 108, the CCT of the combined light matches the CCT of the cool white light. As shown in FIG. 1, the departure of the white light tuning path curve 104 from the BBC 102 increases as the adjustment of the current distribution (i.e., flux/intensity contribution of the warm and cool lights) proceeds from the data point 106 to a data point 110 and decreases from the data point 110 to the data point 108.

Starting from the data point 108, the departure of the white light tuning path curve 104 from the BBC 102 increases as the adjustment of the current distribution among the cool light LED and the warm light LED proceeds from the data point 108 toward the data point 110 and decreases from the data point 110 to the data point 106. In some example embodiments, the data point 110 may represent approximately the midway point between the data points 106 and 108 where the total current provided to the light source is divided approximately equally between the warm light LED and the cool light LED. In some example embodiments, the departure (e.g., 6 McAdam Steps) of the data point 110 and other portions of the white light tuning path curve 104 from the BBC 102 may be undesirably large because of adverse effects on the quality of the combined light provided by the light source.

In some alternative embodiments, the warm white light and the cool white light may have different CCTs than shown in FIG. 1. In some alternative embodiments, the different in the CCTs of the warm light and the cool light may be more or less than shown in FIG. 1.

Figure 2:
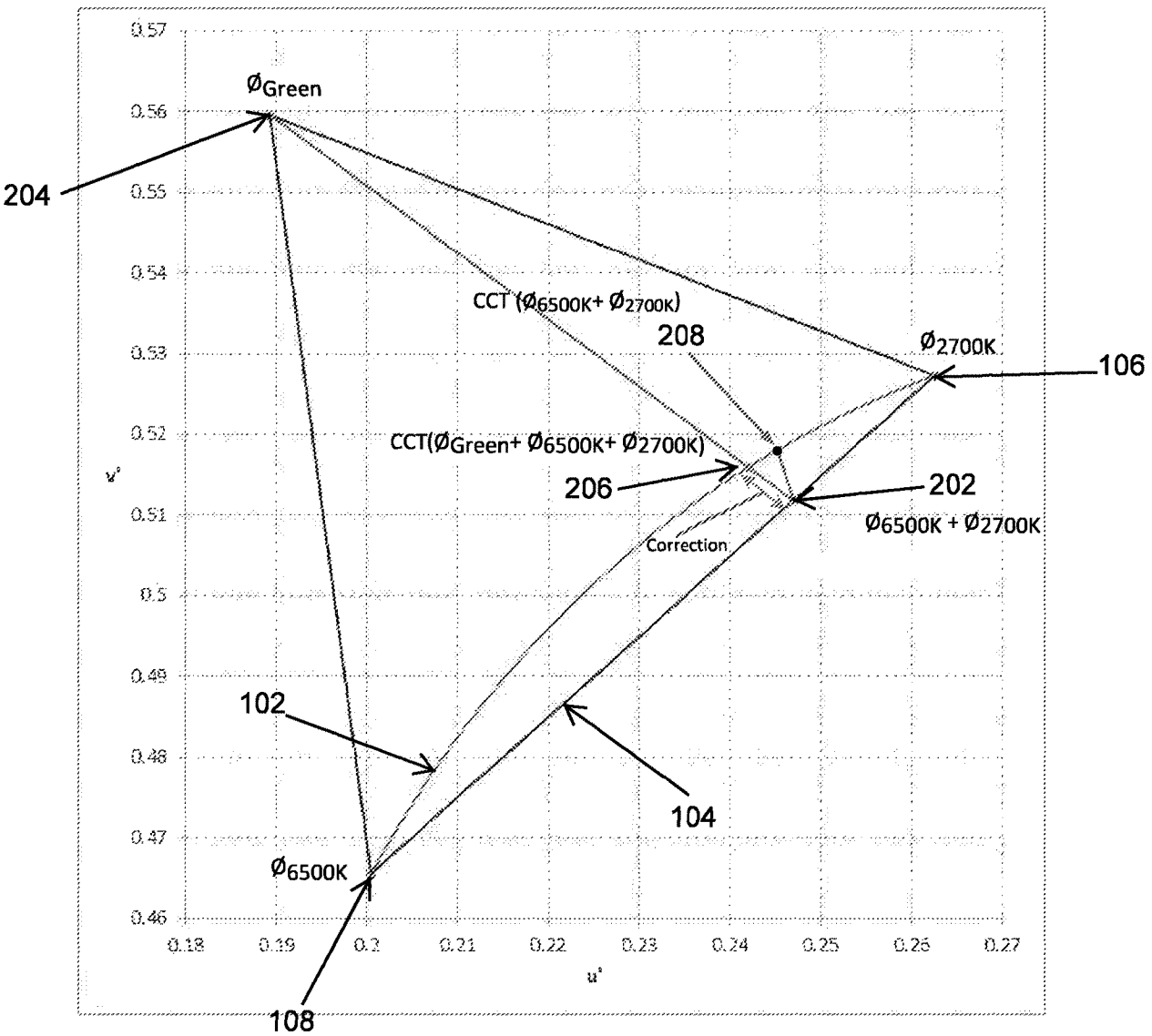
FIGS. 2 and 3 illustrate corrections of the departure of the white light tuning path curve from the BBC based on a green light according to an example embodiment.
Figure 3:
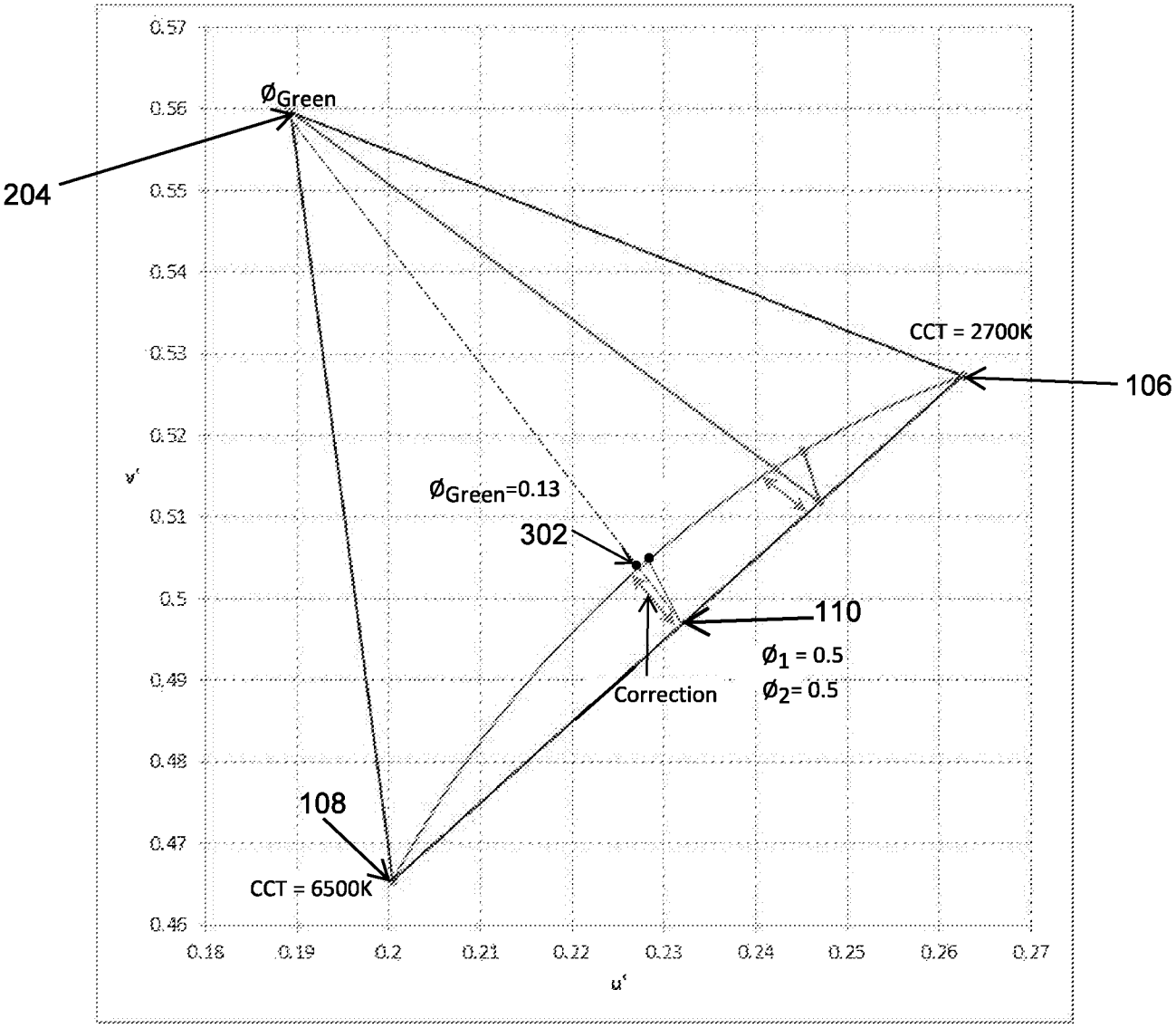
Figure 4:
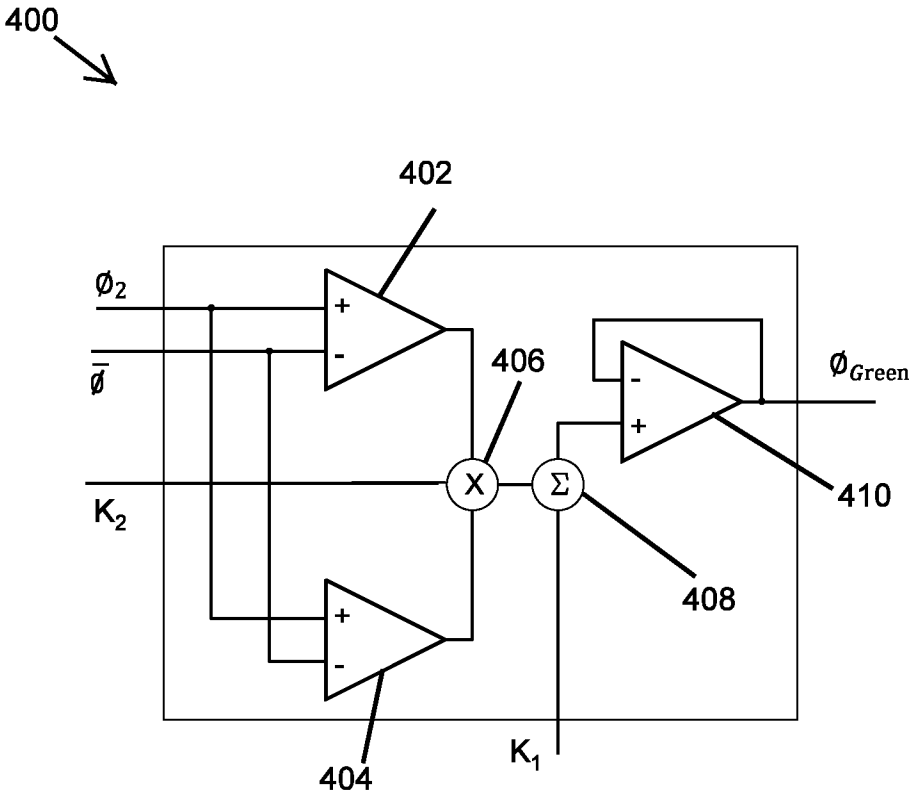
FIG. 4 illustrates an analog circuit for controlling the flux of a green light introduced to correct in real time the departure of the white light tuning path curve from the BBC shown in FIGS. 1-3 according to an example embodiment.
Figure 5:
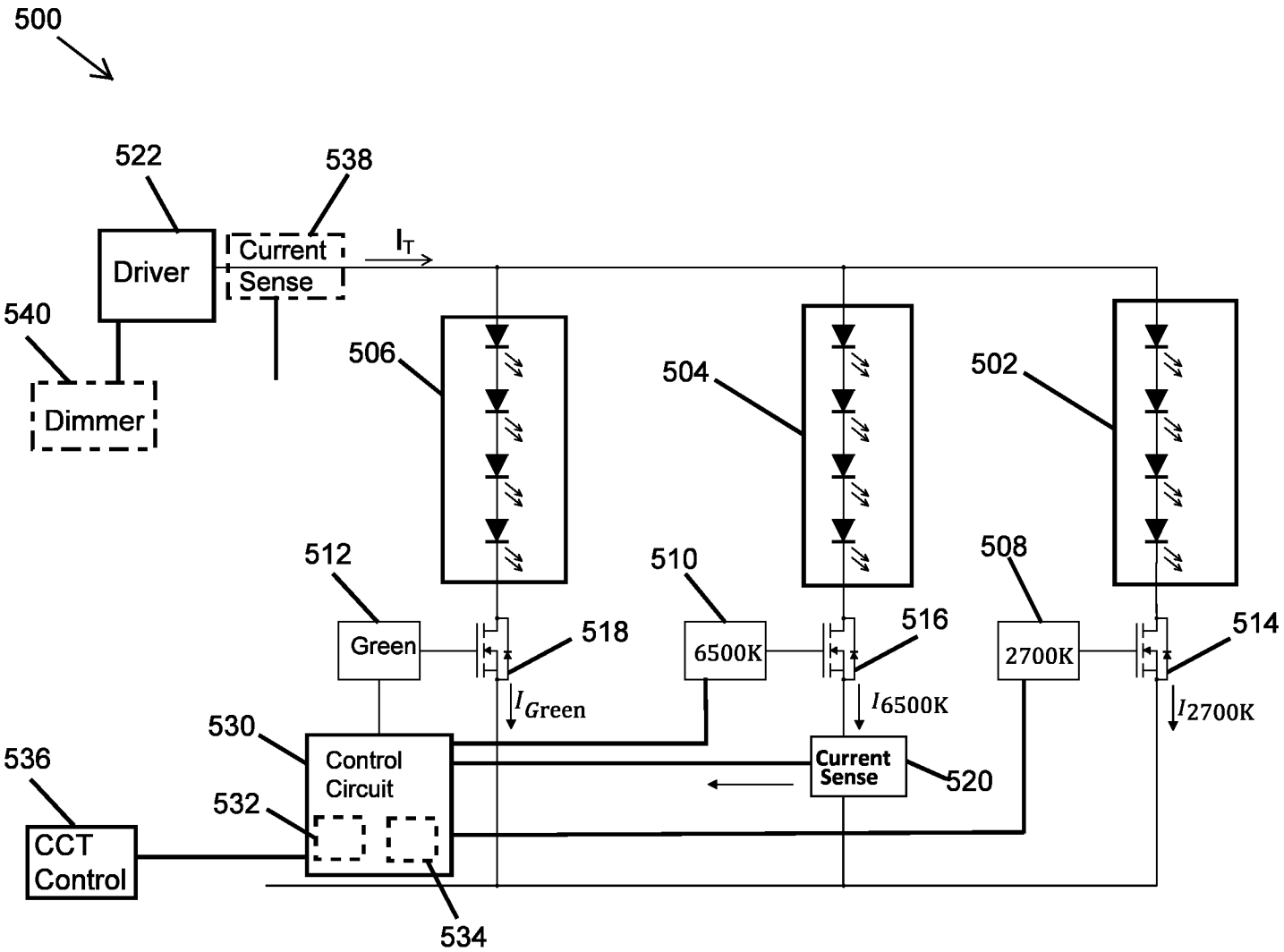
FIG. 5 illustrates a lighting device according to an example embodiment.

FIGS. 2 and 3 illustrate corrections of the departure of the white light tuning path curve 104 from the BBC 102 based on a green light according to an example embodiment. FIG. 4 illustrates an analog circuit 400 for controlling the flux of a green light introduced to correct in real time the departure of the white light tuning path curve 104 from the BBC 102 shown in FIGS. 1-3 according to an example embodiment. FIG. 5 illustrates a lighting device 500 according to an example embodiment. Referring to FIGS. 1-5, in some example embodiments, a green light (i.e., a phosphor converted green light, which may also be referred to as lime light) may be introduced to the combination of a warm white light (e.g., 2700K CCT) and a cool white light (e.g., 6500K CCT) to correct the departure of the white light tuning path curve 104 from the BBC 102. For example, a light source of the lighting device 500 may include a warm light LED 502 that emits a warm white light having a CCT of 2700K, a cool light LED 504 that emits a cool white light having a CCT of 6500K, and a green light LED 506. The LEDs 502, 504, 506 may each include multiple LEDs and may be included in a respective LED light source. The warm light LED 502 may emit the warm white light having a flux $Ø_{2700K}$, and the cool white light LED 504 may emit the cool white light having a flux $Ø_{6500K}$. The green light LED 506 may emit the phosphor converted green light (referred to hearing as a green light) having a flux $Ø_{Green}$. The combined light provided by the light source of the lighting device 500 may be a combination of the green light, the warm light, and the cool light.

In some example embodiments, the flux (or correspondingly, the intensity) of the green light that is introduced to the combined light may be adjusted based on the relationship between the flux of the warm light and the flux of the cool light along the white light tuning path curve 104. That is, the relationship between the flux of the warm light $Ø_{2700K}$ and the flux of the cool light $Ø_{6500K}$ for points along the white light tuning path curve 104 and the departure from the BBC 102 may be used to determine the amount of the flux of the green light $Ø_{Green}$. For example, at the data points 106, 108 in FIGS. 2 and 3, no green light may be introduced because the white light tuning path curve 104 intersects the BBC 102 and thus no correction of the white light tuning path curve 104 is required. On the other hand, the green light may have its highest flux at the data point 110 corresponding to the largest departure of the white light tuning path curve 104 from the BBC 102. After the introduction of the green light provided by the green light LED 506, the data point 110 on the curve 104 is corrected to a point 302 on the BBC as shown in FIG. 3. At the data point 110, the flux of the warm light and the flux of the cool light may approximately equal each other, and the flux of the green light $Ø_{Green}$ may have its maximum value to correct the data point 110 to the point 302 on the BBC 102. That is, the currents directed to the warm light LED 502 and the current directed to the cool light LED 504 may result in the fluxes $Ø_{2700K}$ and $Ø_{6500K}$ being approximately equal to each other.

To illustrate, prior to the introduction of the green light, the combined light resulting from the combination of the warm light having the flux $Ø_{2700K}$ and the cool light having the flux $Ø_{6500K}$ has a combined flux that is the sum of the fluxes $Ø_{2700K}$ and $Ø_{6500K}$. That is, the sum of the fluxes $Ø_{2700K}$ and $Ø_{6500K}$ remains substantially constant at points along the curve 104 prior to the introduction of the green light. For example, for a point 202 on the white light tuning path curve 104, the total flux provided by the light source of the lighting device 500 is the sum of the fluxes $Ø_{2700K}$ and $Ø_{6500K}$ without the contribution of the green light. Prior to the introduction of the green light, the CCT of the combined light at the point 202, CCT ($Ø_{6500K}$+$Ø_{2700K}$), is represented by the point 208 on the BBC 102. When the green light represented by the point 204 in FIG. 2 is introduced to correct the departure of the point 202 from the BBC 102, the total flux of the combined light is a sum of the fluxes $Ø_{Green}$, $Ø_{2700K}$ and $Ø_{6500K}$, and the combined light has a CCT ($Ø_{Green}$+$Ø_{6500K}$+$Ø_{2700K}$) corresponding to the point 206 on the BBC 102.

To illustrate, the point 206 on the BBC 102 corresponds to the intersection of the line extending between the point 202 on the white light tuning path curve 104 and the point 204 representing the green light in the CIE 1976 UCS diagram shown in FIG. 2. The amount of correction (i.e., the amount of the flux of the green light $Ø_{Green}$) that needs to be introduced by the green light to land the CCT of the combined light on the BBC 102 corresponds to the difference between the point 202 on the white light tuning path curve 104 and the point 206 on the BBC 102 and is shown by the label "correction" in FIG. 2. For another point on the white light tuning path curve 104 representing different contributions of the fluxes $Ø_{6500K}$ and $Ø_{2700K}$, the amount of flux $Ø_{Green}$ that needs to be introduced by the green light to land the CCT of the combined light on the BBC 102 corresponds to the difference between that particular point on the white light tuning path curve 104 and the intersection of the BBC 102 and a line extending between that particular point and the point 204.

In some example embodiments, for individual points along the white light tuning path curve 104, the amount of the flux of the green light $Ø_{Green}$ that needs to be introduced to correct the departure of the white light tuning path curve 104 from the BBC 102 may be approximated by a second degree curve (e.g., a parabola). For example, Equations 1 and 2 below may be used to determine the amount of flux of the green light (or correspondingly, current or voltage provided to the green light LED) that needs to be introduced to correct the departure of the white light tuning path curve 104 from the BBC 102.

$$\phi_{Green} = \phi_{GMax}\left(1 - \frac{(\varnothing_2 - \overline{\varnothing})^2}{\overline{\varnothing}^2}\right) = \phi_{GMax} - \frac{\phi_{GMax}}{\overline{\varnothing}^2}(\phi_2 - \overline{\varnothing})^2 \quad \text{Equation 1}$$

$$\phi_{Green} = K_1 - K_2(\phi_2 - \overline{\phi})^2 \quad \text{Equation 2}$$

In Equation 1, $Ø_{Green}$ refers to the flux of the green light; $Ø_2$ refers to the flux of the warm light $Ø_{2700}$ or the flux of the cool light $Ø_{6500}$; $\overline{Ø}$ refers to the constant reference value corresponding to the flux of the warm light $Ø_{2700}$ or the flux of the cool light $Ø_{6500}$ at the largest departure of the white light tuning path curve 104 from the BBC 102 (e.g., at the point 110 in FIG. 3); and $Ø_{GMax}$ is the maximum value of the flux of the green light $Ø_{Green}$ at the maximum departure of the white light tuning path curve 104 from the BBC 102 (e.g., at the point 110 in FIG. 3). Equation 2 is a simplified form of Equation 1, where $K_1$ equals $Ø_{GMax}$, and $K_2$ equals $$\frac{\phi_{GMax}}{\overline{\phi}^2}.$$

In some example embodiments, $Ø_{GMax}$ may be determined using the chromaticity diagram of FIG. 3. To illustrate, the point 302 on the BBC 102 is the intersection of the line extending between the point 110 and the point 204. Because the chromaticity diagram in FIG. 3 is a linear graph, the correction (i.e., the distance between the points 110 and 302) may be translated to the amount of the flux of the green light $Ø_{Green}$. Because the point 110 corresponds to the maximum departure of the curve 104 from the BBC 102, the value of the flux of the green light $Ø_{Green}$ that is provided by the green light LED 506 is $Ø_{GMax}$.

In some example embodiments, Equations 1 or 2 may be used to determine the flux of the green light $Ø_{Green}$ based on the flux of the cool light $Ø_{6500}$ or based on the flux of the warm light $Ø_{2700}$. Because the fluxes of the warm, cool, and green lights correspond to the respective currents provided to the warm light LED, the cool light LED, and the green light LED, the flux values in Equations 1 and 2 may be replaced with corresponding current values that account for the characteristics of the particular LEDs.

In some example embodiments, the analog circuit 400 shown in FIG. 4 may be used to perform a continuous real time correction of the departure of the white light tuning path curve 104 from the BBC 102 based on Equation 2 above. For example, an analog multiplier component, part number AD633JR/AD633AR, may be used to implement the analog circuit 400. To illustrate, the analog circuit 400 may include difference amplifiers 402, 404, a multiplier 406, a summing node 408, and an amplifier 410 that are connected to generate an output to control the amount of the flux of the green light $Ø_{Green}$ provided by the green light LED 506 to correct the departure of the white light tuning path curve 104 from the BBC 102. In FIG. 4, the inputs provided to the analog circuit 400 and the output provided by the analog circuit 400 may be voltages corresponding to the parameters of Equation 2 above. In some alternative embodiments, the analog circuit 400 may include other components, a different configuration of components, or different components than shown without departing from the scope of this disclosure In some example embodiments, Equation 1 or 2 may be used to generate a lookup table that has a mapping of the flux of the cool light $Ø_{6500K}$ to the flux of the green light $Ø_{Green}$ that should be provided by the green light LED 506 to correct the departure of the white light tuning path curve 104 from the BBC 102 for points along the white light tuning path curve 104. Alternatively, Equation 1 or 2 may be used to generate a lookup table that has a mapping of the flux of the warm light $Ø_{2700K}$ provided by the warm light LED 502 to the flux of the green light $Ø_{Green}$ that should be provided by the green light LED 506 to correct the departure of the white light tuning path curve 104 from the BBC 102 for points along the white light tuning path curve 104. The lookup table may be generated based on a normalized total flux (i.e., normalized to 1), where the total flux is the sum of the fluxes $Ø_{2700K}$, $Ø_{6500K}$, and $Ø_{Green}$ (e.g., the flux of the illumination light provided by the light source of the lighting device 500). An example lookup table that has the mapping of the values of the cool light flux $Ø_{6500K}$ to values of the green light flux $Ø_{Green}$ is shown in Table 1. In some alternative embodiments, a lookup table may be generated based on a normalized total flux, where the total flux is the sum of the fluxes $Ø_{2700K}$ and $Ø_{6500K}$ without departing from the scope of this disclosure.

TABLE 1

| Ø6500K | ØGreen |
|---|---|
| 0 | 0 |
| 0.04 | 0.018923 |
| 0.08 | 0.035345 |
| 0.12 | 0.050523 |
| 0.16 | 0.064239 |
| 0.2 | 0.076719 |
| 0.24 | 0.088049 |
| 0.28 | 0.098188 |
| 0.32 | 0.107063 |
| 0.36 | 0.114592 |
| 0.4 | 0.120762 |
| 0.44 | 0.125526 |
| 0.48 | 0.128643 |
| 0.52 | 0.130286 |
| 0.56 | 0.130061 |
| 0.6 | 0.128272 |
| 0.64 | 0.124569 |
| 0.68 | 0.118825 |
| 0.72 | 0.111214 |

TABLE 1-continued

| Ø6500K | ØGreen |
|---|---|
| 0.76 | 0.101813 |
| 0.8 | 0.090261 |
| 0.84 | 0.076599 |
| 0.88 | 0.060763 |
| 0.92 | 0.042853 |
| 0.96 | 0.02242 |
| 1 | 0 |

In some example embodiments, because the fluxes of the lights provided by the LEDs 502, 504, 506 are related to the current provided to the respective LEDs 502, 504, 506, the lighting device 500 (e.g., a lighting fixture) may include a control circuit 530 that controls the amount of current that should be provided to the green light LED 506 based on the current that is provided to the cool light LED 504 as shown in FIG. 5 or based on the current that is provided to the warm light LED 502. In some example embodiments, because the current provided to the cool light LED 504 or to the warm light LED 502 depends on the color temperature setting of the lighting device 500, in some example embodiments, the lookup table may include the mapping of CCT setting values (e.g., CCT values) to values of the flux of the green light (or amounts of current that should flow through the green light LED). In some example embodiments, a lookup table may map the flux of the warm light $Ø_{2700K}$ or the flux of the cool light $Ø_{6500K}$ to the flux of the green light $Ø_{Green}$ as a portion of the total flux. In some alternative embodiments, another lookup table that has different mappings (e.g., based on current, light dim level, light dim level associated with CCT values, or another parameter) may be used without departing from the scope of this disclosure.

In some example embodiments, the lighting device 500 may include a control circuit 530 that controls the operations of the lighting device 500 to adjust the CCT of the light provided by the light source of the lighting device 500. To illustrate, the light source of the lighting device 500 may include the warm light LED 502, the cool light LED 504, and the green light LED 506 as shown in FIG. 5. The control circuit 530 may control the current flow through the warm light LED 502 by controlling a transistor 514 through a driver circuit 508 (e.g., a buffer), the control circuit 530 may control current flow through the cool light LED 504 by controlling a transistor 516 through a drive circuit 510 (e.g., a buffer). For example, the control circuit 530 may control the currents $I_{2700K}$ and $I_{6500K}$ based on a CCT setting input provided by a user control device 536 (e.g., a wall unit, a handheld device, etc.) via a wired connection or wirelessly.

In some example embodiments, to control the flux $Ø_{Green}$ of the light provided by the green light LED 506, the control circuit 530 may control the amount of a current $I_{Green}$ that flows through the green light LED 506 by controlling the transistor 518 through the drive circuit 512 (e.g., a buffer). For example, the control circuit 530 may include the analog circuit 400 that outputs a control signal that is provided to the transistor 518 through the drive circuit 512. To illustrate, an output of a current sense circuit 520 that is indicative of the amount of the current $I_{6500K}$ flowing through the cool light LED 504 may be provided to the analog circuit 400 at the Ø2 input, and the analog circuit 400 may generate the control signal provided to the transistor 518 to control the amount of the current $I_{Green}$, which corresponds to the amount of the flux $Ø_{Green}$ of the green light emitted by the green light LED 506.

In some example embodiments, the control circuit 530 may include a controller 532 (e.g., a microcontroller) and a memory device 534 (e.g., a flash memory) instead of or in addition to the analog circuit 400. For example, the memory device 532 may store one or more lookup tables such as the lookup table shown in Table 1. The memory device 534 may also include software code executable by the controller 532 to implement some of the operations described herein with respect to the control circuit 530. For example, the analog circuit 400 may be omitted, and the controller 532 may use the lookup table stored in the memory device 534 and the output of the current sense circuit 520 that is indicative of the amount of the current $I_{6500K}$ (and thus, the flux $Ø_{6500K}$) to control the amount of the flux $Ø_{Green}$ by controlling the transistor 518. For example, the controller 532 may use the flux $Ø_{Green}$ values in the lookup table stored in the memory device 534 to generate the control signal provided to the transistor 518 through the drive circuit 512. The control circuit 530 may include components such as an analog-to-digital (A/D) converter and a digital-to-analog (D/A) converter for use with inputs and outputs to/from the controller 532.

In some example embodiments, when the lookup table (e.g., the lookup table shown in Table 1) includes normalized values of the flux $Ø_{6500K}$, the controller 532 may use the total current $I_T$ that is provided by a driver 522 (e.g., a constant current driver) of the lighting device 500 to scale the values in the lookup table or the current $I_{6500K}$ indicated by the current sense circuit 520. For example, the total current $I_T$ may be known based on the specification of the driver 522 or based on an optional current sense circuit 538 that provides to the control circuit 530 information (e.g., a voltage) indicative of the total current $I_T$. The values of the constant inputs to the analog circuit 400 may also be generated/scaled by the control circuit 530 based on reference constant values (i.e., constant generated based on normalized values) and based on the total current $I_T$ as can be readily understood by those of ordinary skill in the art with the benefit of this disclosure.

In some example embodiments, a dimmer 540 (e.g., a wall dimmer) may control the total current $I_T$ provided to the light source of the lighting device 500 by the driver 522. For example, the total current $I_T$ may be changed based on the setting of the dimmer 540, and the control circuit 530 may control the currents $I_{Green}$, $I_{6500K}$, and $I_{2700K}$ based on the actual total current $I_T$ instead of the specified total current of the driver 522.

By using the analog circuit 400 and/or a lookup table generated based on the Equation 1 or 2, the control circuit 530 can implement an approximation of the flux of the green light $Ø_{Green}$ based on a second degree curve. The approximation of the flux of the green light $Ø_{Green}$ based on a second degree curve as described above can result in the white light tuning curve of the light provided by the lighting device 100 to closely follow the BBC 102.

In some alternative embodiments, the lookup table stored in the memory device 534 may be based on the flux of the flux $Ø_{2700K}$ instead of the flux $Ø_{6500K}$ without departing from the scope of this disclosure. For example, the current sense circuit 520 may be located to the sense the current $I_{2700K}$ instead of the current $I_{6500K}$. In some alternative embodiments, a light other than a green light may be used to correct the departure of the curve 104 from the BBC 102. In some alternative embodiments, the green light may be at a different location of the chromaticity chart than shown. In some alternative embodiments, the warm light may have a CCT other than 2700K, and the cool light may have a CCT other than 6500K. In some alternative embodiments, some of the components of the lighting device 100 may be omitted or integrated into a single device without departing from the scope of this disclosure. In some example embodiments, a lighting system that includes the user control device 536, the dimmer 540, and the lighting device 100 may include other lighting devices (e.g., multiple ones of the lighting device 100) that may be controlled by the user control device 536 and/or the dimmer 540.

Figure 6A:
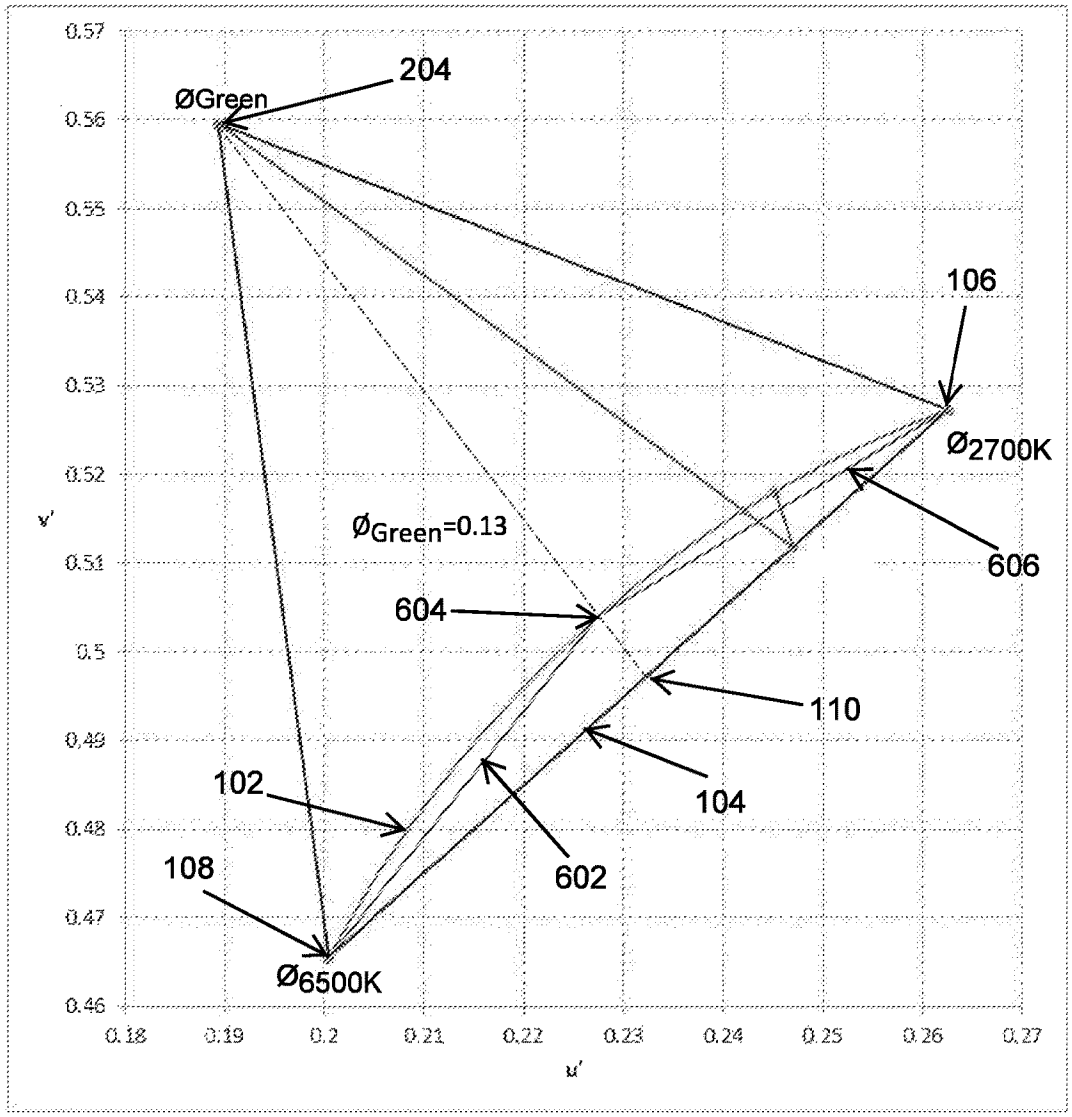
FIGS. 6A and 6B illustrate a linear white light tuning path curve based on a linear approximation of the flux of the green light according to an example embodiment.
Figure 6B:
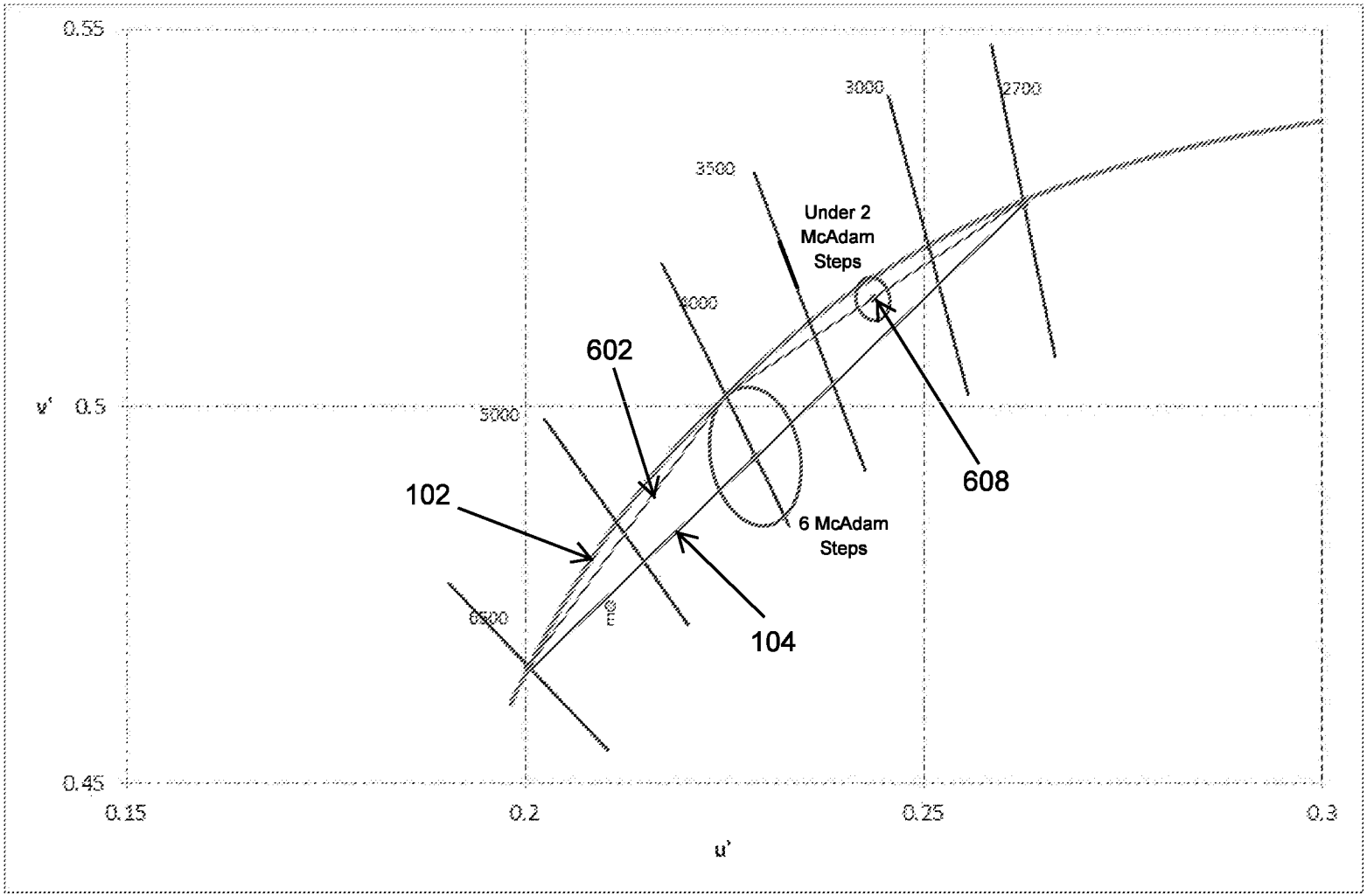
Figure 7:
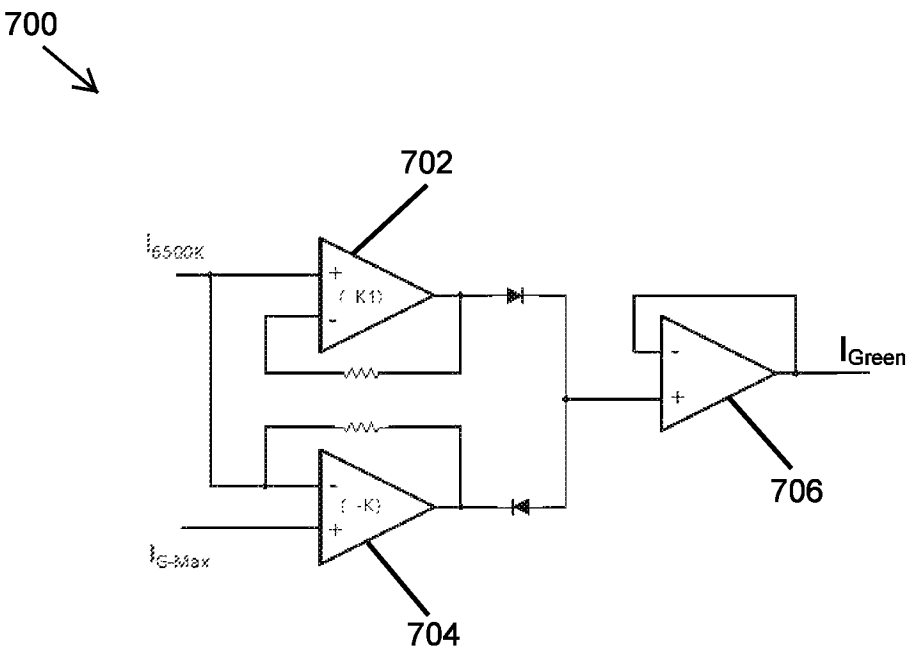
FIG. 7 illustrates an analog circuit for controlling the green light LED based on a linear approximation of the flux of the green light according to an example embodiment.

FIGS. 6A and 6B illustrate a linear white light tuning path curve based on a linear approximation of the flux of the green light $Ø_{Green}$ according to an example embodiment. FIG. 7 illustrates an analog circuit 700 for controlling the green light LED 506 based on a linear approximation of the flux of the green light $Ø_{Green}$ according to an example embodiment. Referring to FIGS. 5-7, in some example embodiments, the control circuit 530 of the lighting device 500 may include the analog circuit 700 instead of the analog circuit 400. For example, the analog circuit 700 may include operational amplifiers 702, 704, 706 that are connected as shown in FIG. 3 to implement Equation 3 provided below:

$$I_{Green} = \begin{cases} K_1 I_{6500K}, & \text{if } I_{6500K} \le \bar{I} \\ I_{Gmax} - K_2 I_{6500K}, & \text{if } I_{6500K} > \bar{I} \end{cases} \qquad \text{Equation 3}$$

In Equation 3, $I_{Green}$ is corresponds to the current through the green light LED; K is an amplification gain of the operational amplifier 704; $K_1$ is the slope of the linear path 602; $-K_2=-K\times K_1$; $\bar{I}$ corresponds to the value of the current $I_{6500K}$ at the point 110 on the curve 104. $I_{6500K}$ is the current flowing through the cool light LED 504; and $I_{GMax}$ is the maximum value of the current $I_{Green}$ through the green light LED 506 at the point 110, which corresponds to the maximum departure of the white light tuning path curve 104 from the BBC 102 as shown in FIG. 6A.

$I_{GMax}$, which corresponds to the $Ø_{GMax}$ described above, may be determined using the chromaticity diagram of FIG. 6A. To illustrate, the point 604 on the BBC 102 is the intersection of the line extending between the point 110 and the point 204. Because the chromaticity diagram in FIG. 6A is a linear graph, the separation (i.e., the amount of correction) between the point 110 and the point 604 may be translated to the amount of the flux of the green light $Ø_{Green}$ (and correspondingly to the current $I_{Green}$). Because the point 110 corresponds to the maximum departure of the curve 104 from the BBC 102, the value of the flux of the green light $Ø_{Green}$ that is provided by the green light LED 506 is $Ø_{GMax}$, which corresponds to the maximum value $I_{GMax}$ of the current $I_{Green}$.

The operational amplifier 704 of the analog circuit 700 of FIG. 7 receives a voltage corresponding to the current $I_{GMax}$. In the lighting device 500, the voltage corresponding to the current $I_{GMax}$ may be scaled based on the total current $I_T$, and the output voltage from the current sense circuit 520 may be provided to the operational amplifiers 702, 704 of the analog circuit 700 as the $I_{6500K}$ input. The analog circuit 700 may generate a voltage at its $I_{Green}$, which is provided to the transistor 518 to control the current $I_{Green}$ through the green light LED 506.

In some example embodiments, the linear white light tuning path that results from Equation 3 and the analog circuit 700 includes the linear paths 602, 606. For example, at the point 604, the departure of the linear white light tuning path from the BBC is zero. As shown in FIG. 6B, the point 608 on the linear path 606 is significantly closer to the BBC 102 than a corresponding point on the curve 104.

In some example embodiments, the controller 532 and the memory device 534 as well as the analog circuit 400 may be omitted from the control circuit 530, and the analog circuit 700 may be used to control the current through $I_{Green}$ through the green light LED 506, thus controlling the flux of the green light $Ø_{Green}$. In some alternative embodiments, the linear white light tuning paths 602, 604 may be implemented based on the flux of the warm light provided by the warm light LED 502 without departing from the scope of this disclosure. In general, references to fluxes of different lights may be linearly mapped to currents flowing through the corresponding LEDs that emit the lights and vice versa.

In some alternative embodiments, the analog circuit 700 may include other components without departing from the scope of this disclosure. In some alternative embodiments, the control circuit 530 may include other components (e.g., A/D converter) without departing from the scope of this disclosure.

Figure 8:
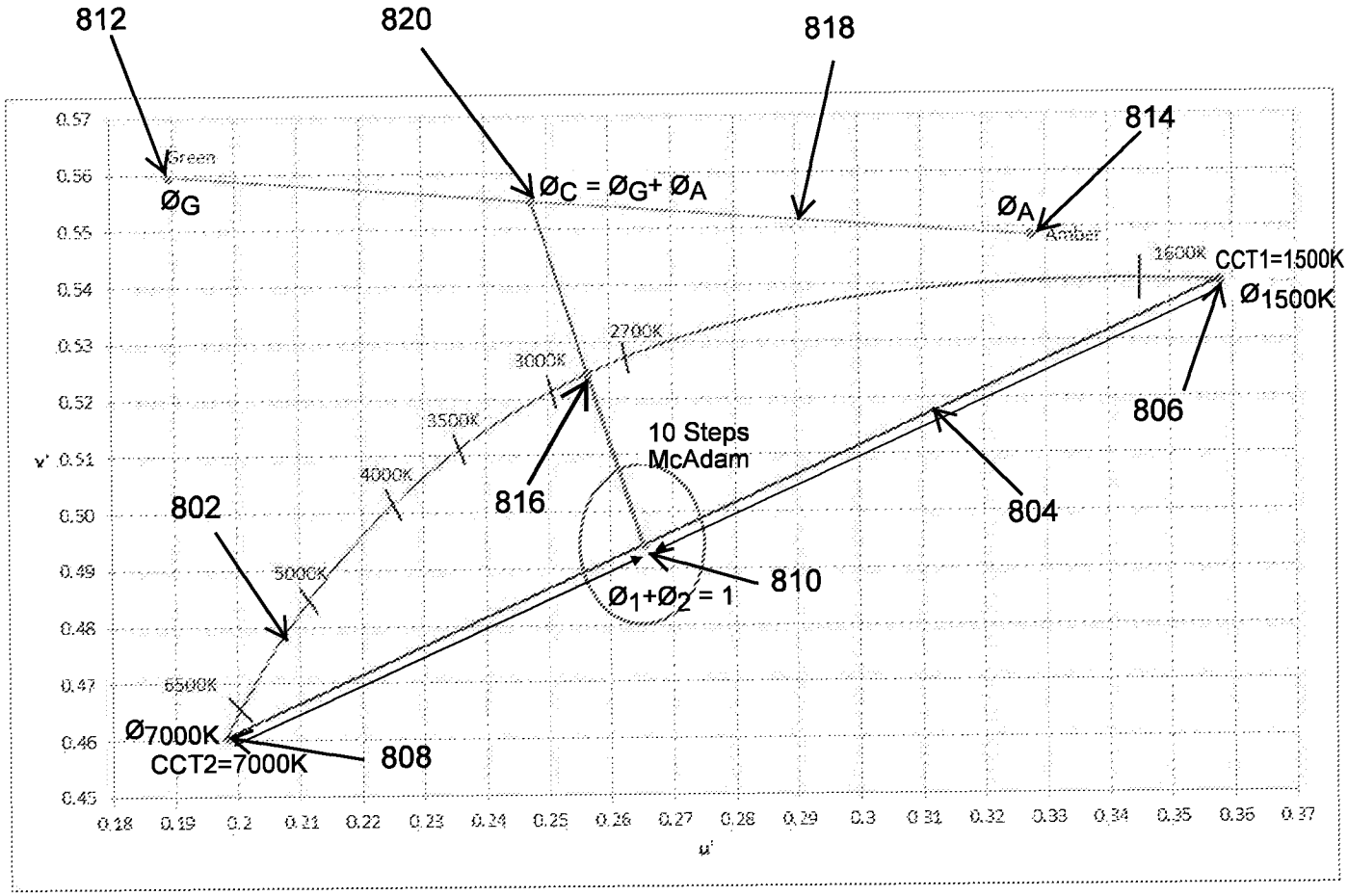
FIG. 8 illustrates a chromaticity diagram showing a white light tuning path curve and the black-body curve (BBC) according to another example embodiment.
Figure 9:
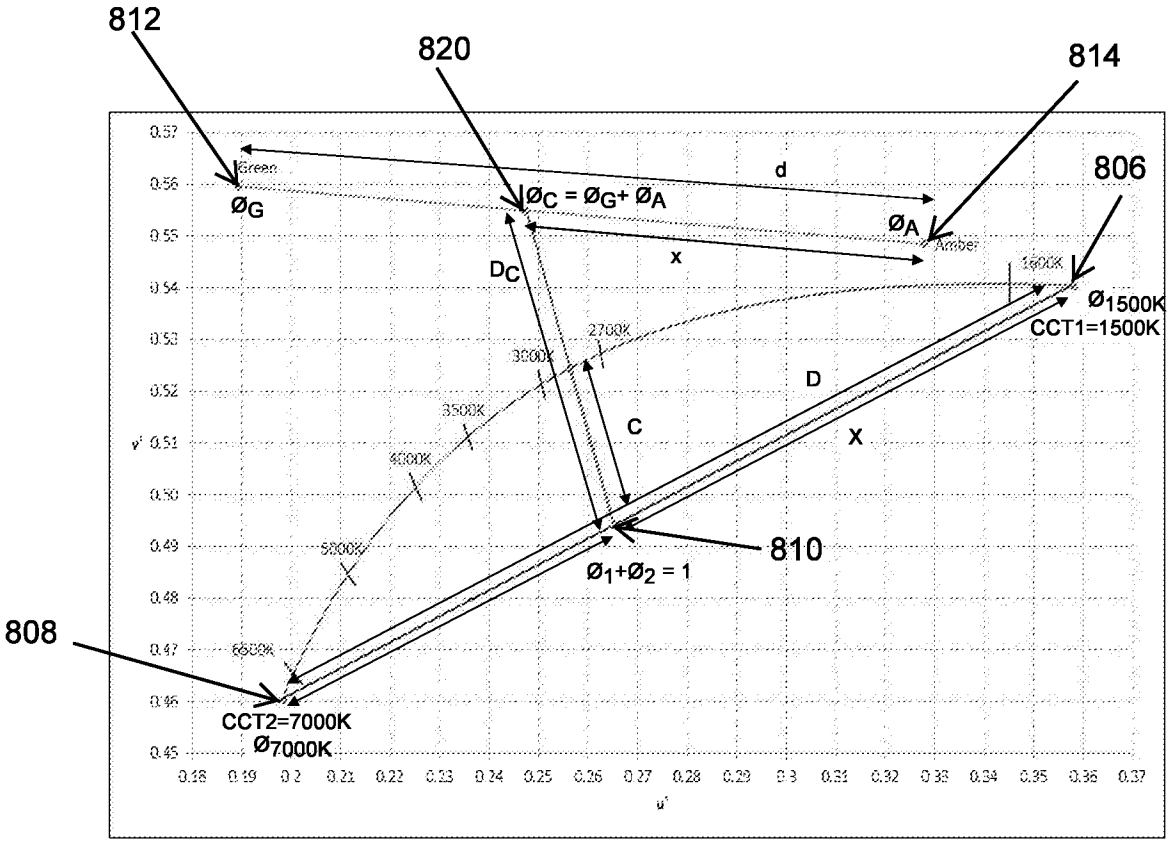
FIG. 9 illustrates some parameters associated with the correction of the departure of the white light tuning path curve from the BBC based on green light and amber light according to an example embodiment.
Figure 10:
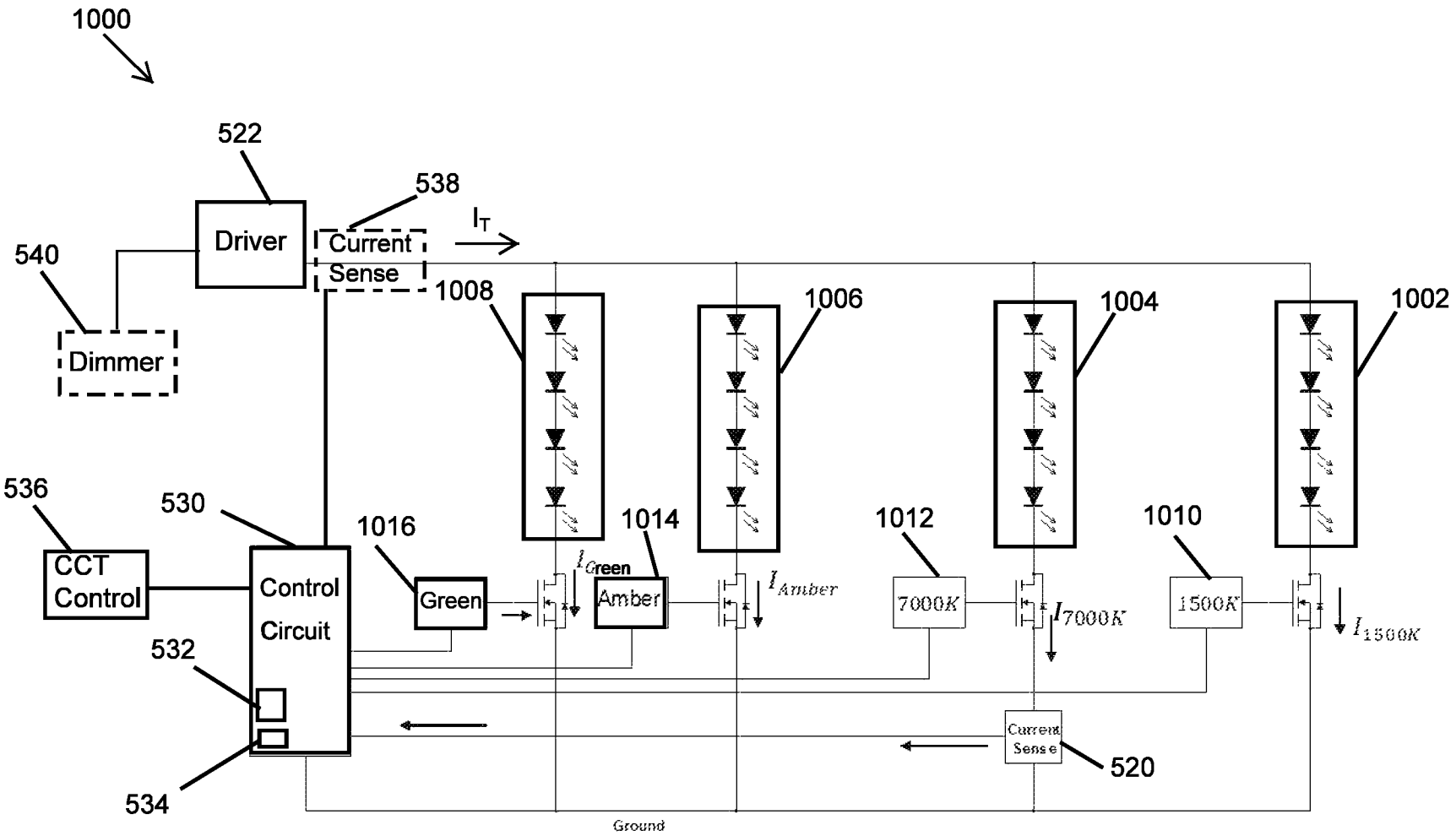
FIG. 10 illustrates a lighting device according to another example embodiment.

FIG. 8 illustrates a chromaticity diagram showing a white light tuning path curve 804 and the black-body curve (BBC) 802 according to another example embodiment. FIG. 9 illustrates parameters associated with the correction of the departure of the white light tuning path curve 804 from the BBC 802 based on a green light and an amber light according to an example embodiment. FIG. 10 illustrates a lighting device according to another example embodiment. Referring to FIGS. 8-10, in some applications, a lighting device 1000 (e.g., a lighting fixture) may include a light source that includes a warm white light LED 1002, a cool white light LED 1004 that have a relatively wide separation in CCT. For example, the warm light emitted by the LED 1002 may have a CCT of 1500K, and the cool light emitted by the LED 1004 may have a CCT of 7000K. In such cases, the introduction of a single color light, such as a green light only, may be inadequate to satisfactorily correct the departure of the white light tuning path curve 804 from the BBC 802.

In FIGS. 8 and 9, the data point 806 may correspond to the warm light emitted by the LED 1002 (i.e., no cool light is emitted), and the data point 808 may correspond to the cool light emitted by the LED 1004 (i.e., no warm light is emitted). In some example embodiments, a variable point 820 along a straight line 818 connecting two data points 812 and 814 that are sufficiently spaced apart above the BBC 802 may be used to correct the departure of the white light tuning path curve 804 from the BBC 802. For example, the data point 812 may correspond to a green light (e.g., PC green) emitted by a green light LED 1006 of the light source of the lighting device 1000, and the data point 814 may correspond to an amber light emitted by an amber light LED 1008 of the light source of the lighting device 1000. In some alternative embodiments, one or both data points 812, 814 may be at different locations than shown without departing from the scope of this disclosure. The LEDs 1002, 1004, 1106, 1008 may each include multiple LEDs and may be included in a respective LED light source.

In some example embodiments, points along the line 818 correspond to the sum of the flux of the green light $Ø_G$ and the flux of the amber light $Ø_A$. For example, the variable point 820 may correspond to a total correction flux that is the sum of the flux of the green light $Ø_G$ and the flux of the amber light $Ø_A$ that are added to correct the departure of the curve 804 at point 810 from the BBC 802 such that the point 810 is moved to the point 816 on the BBC 802. The location of the variable point 820 on the line 818 may be changed based on the proportions of flux of the warm light $Ø_{1500K}$ and the flux of the cool light $Ø_{7000K}$. For example, the proportion of the flux of the green light $Ø_G$ to the flux of the amber light $Ø_A$ may match the proportion of the flux of the cool light $Ø_{7000K}$ to the flux of the warm light $Ø_{1500K}$. That is, in some example embodiments, the variable point 820 may be proportional to the location of the light source resultant coordinates (e.g., coordinates at data point 806) between the two extreme points 806, 808 (e.g., corresponding to 1500K and 7000K).

In some example embodiments, the equations provided below may be used to determine the fluxes $Ø_G$ and $Ø_A$ of the green light and the amber light that should be combined with the warm light provided by the LED 1002 and the cool light provided by the LED 1004. A lookup table may be populated based on the values of the fluxes $Ø_{1500K}$, $Ø_{7000K}$, $Ø_G$, and $Ø_A$, where, for a particular value of the flux $Ø_{1500K}$ or the flux $Ø_{7000K}$ in a row of the lookup table, the amounts of the fluxes $Ø_G$ and $Ø_A$ that are needed to correct the departure of the white light tuning path curve 804 from the BBC 802 are shown. In the equations below that are used to determine the total values of the fluxes $Ø_G$ and $Ø_A$, the sum of the fluxes $Ø_{1500K}$, $Ø_{7000K}$, $Ø_G$, and $Ø_A$ is normalized to 1, and ØCorrection is the sum of the $Ø_G$ and $Ø_A$. In some alternative embodiments, the sum of the fluxes $Ø_{1500K}$ and $Ø_{7000K}$, $Ø_G$ may be normalized to 1 without departing from the scope of this disclosure. The parameters X, D, x, d, C, Dc used in the equations below are shown in FIG. 9 and can be determined based on the coordinates in the chromaticity diagram of FIG. 9. ØCorrection is the sum of the $Ø_G$ and $Ø_A$.

$$X = D\frac{\phi_{7000K}}{\phi_{1500K} + \phi_{7000K}}$$

$$\phi_{1500K} + \phi_{7000K} + \phi_{Correction} = 1$$

$$x = X\frac{d}{D}$$

$$C = D_C\frac{\phi_{Correction}}{\phi_{1500K} + \phi_{7000K} + \phi_{Correction}}$$

$$C = D_C\frac{\phi_{Correction}}{1}$$

$$\phi_{Correction} = \frac{C}{D_C}$$

$$\phi_{Correction} = \phi_A + \phi_G$$

$$\phi_G = \phi_{Correction}\frac{x}{d} = \frac{C}{D_C}\frac{x}{d}$$

$$\phi_A = \frac{C}{D_C}\left(1 - \frac{x}{d}\right)$$

An example lookup table that may be generated based on the above equations is shown in Table 2. In Table 2, the CCT column corresponds to CCT setting input that may be provided to the control circuit 530 of the lighting device 1000 by the user control device 536, and the normalized values of the $Ø_{1500K}$ and the $Ø_{7000K}$ are used to control the fluxes $Ø_{1500K}$ and $Ø_{7000K}$ provided by the LEDS 1002, 1004, respectively, based on the values in the CCT column.

TABLE 2

| CCT | Φ1500K | Φ7000K | Φcorrection | ΦG | ΦA |
|---|---|---|---|---|---|
| 1500 | 1.00 | 0.00 | 0.00 | 0.00 | 0.00 |
| 1567 | 0.80 | 0.02 | 0.19 | 0.00 | 0.18 |
| 1624 | 0.66 | 0.03 | 0.32 | 0.01 | 0.30 |

TABLE 2-continued

| CCT | Φ1500K | Φ7000K | Φcorrection | ΦG | ΦA |
|---|---|---|---|---|---|
| 1668 | 0.58 | 0.04 | 0.39 | 0.02 | 0.36 |
| 1706 | 0.52 | 0.05 | 0.43 | 0.03 | 0.40 |
| 1744 | 0.48 | 0.05 | 0.47 | 0.05 | 0.42 |
| 1782 | 0.44 | 0.06 | 0.50 | 0.06 | 0.44 |
| 1818 | 0.41 | 0.07 | 0.52 | 0.07 | 0.45 |
| 1854 | 0.39 | 0.07 | 0.54 | 0.09 | 0.45 |
| 1890 | 0.37 | 0.08 | 0.55 | 0.10 | 0.45 |
| 1926 | 0.35 | 0.09 | 0.56 | 0.11 | 0.45 |
| 1963 | 0.33 | 0.09 | 0.57 | 0.13 | 0.45 |
| 2000 | 0.32 | 0.10 | 0.58 | 0.14 | 0.44 |
| 2038 | 0.31 | 0.11 | 0.58 | 0.15 | 0.43 |
| 2076 | 0.30 | 0.12 | 0.58 | 0.16 | 0.42 |
| 2116 | 0.29 | 0.12 | 0.59 | 0.18 | 0.41 |
| 2157 | 0.28 | 0.13 | 0.58 | 0.19 | 0.40 |
| 2199 | 0.28 | 0.14 | 0.58 | 0.20 | 0.38 |
| 2242 | 0.27 | 0.15 | 0.58 | 0.21 | 0.37 |
| 2287 | 0.26 | 0.16 | 0.58 | 0.22 | 0.36 |
| 2333 | 0.26 | 0.17 | 0.57 | 0.23 | 0.34 |
| 2381 | 0.25 | 0.18 | 0.57 | 0.24 | 0.33 |
| 2431 | 0.25 | 0.19 | 0.36 | 0.25 | 0.31 |
| 2482 | 0.24 | 0.20 | 0.55 | 0.26 | 0.30 |
| 2536 | 0.24 | 0.22 | 0.55 | 0.26 | 0.28 |
| 2593 | 0.23 | 0.23 | 0.54 | 0.27 | 0.27 |
| 2652 | 0.23 | 0.24 | 0.53 | 0.28 | 0.25 |
| 2713 | 0.22 | 0.26 | 0.52 | 0.28 | 0.24 |
| 2778 | 0.22 | 0.27 | 0.51 | 0.29 | 0.22 |
| 2846 | 0.21 | 0.29 | 0.50 | 0.29 | 0.21 |
| 2918 | 0.21 | 0.31 | 0.49 | 0.29 | 0.19 |
| 2994 | 0.20 | 0.33 | 0.47 | 0.29 | 0.18 |
| 3064 | 0.19 | 0.35 | 0.46 | 0.29 | 0.17 |
| 3159 | 0.19 | 0.37 | 0.45 | 0.29 | 0.15 |
| 3252 | 0.18 | 0.39 | 0.43 | 0.29 | 0.14 |
| 3347 | 0.18 | 0.41 | 0.42 | 0.29 | 0.12 |
| 3451 | 0.17 | 0.43 | 0.40 | 0.29 | 0.11 |
| 3562 | 0.16 | 0.46 | 0.38 | 0.28 | 0.10 |
| 3683 | 0.15 | 0.49 | 0.36 | 0.27 | 0.09 |
| 3814 | 0.14 | 0.51 | 0.34 | 0.27 | 0.08 |
| 3957 | 0.14 | 0.54 | 0.32 | 0.26 | 0.06 |
| 4114 | 0.13 | 0.58 | 0.30 | 0.24 | 0.05 |
| 4287 | 0.12 | 0.61 | 0.27 | 0.23 | 0.04 |
| 4480 | 0.11 | 0.65 | 0.25 | 0.21 | 0.03 |
| 4697 | 0.09 | 0.69 | 0.22 | 0.19 | 0.03 |
| 4942 | 0.08 | 0.73 | 0.19 | 0.17 | 0.02 |
| 5224 | 0.07 | 0.78 | 0.16 | 0.14 | 0.01 |
| 5552 | 0.05 | 0.82 | 0.12 | 0.12 | 0.01 |
| 5941 | 0.04 | 0.88 | 0.09 | 0.08 | 0.00 |
| 6412 | 0.02 | 0.94 | 0.04 | 0.04 | 0.00 |
| 7000 | 0.00 | 1.00 | 0.00 | 0.00 | 0.00 |

In some example embodiments, a lookup table may be used by the control circuit 530 to control the fluxes $Ø_G$ and $Ø_A$. For example, the control circuit 530 of the lighting device 1000 may include the controller 532 and the memory device 534, and the memory device 534 may include a lookup table that includes, for example, all or some of the columns of Table 2. The control circuit 530 may generate outputs to control the transistors driven by the drive circuits 1010-1016 based on the lookup table. Because current values and flux values are correlated with each other, the controller 532 can readily translate flux values to current values and vice versa as can be readily understood by those of ordinary skill in the art with the benefit of this disclosure.

In some example embodiments, the controller 532 may receive a voltage from the current sense circuit 520 that indicates the amount of the current $I_{7000K}$ flowing through the cool light LED 1004. Based on the lookup table, the current $I_{7000K}$ as indicated by the current sense circuit 520, and the total current $I_T$, the control circuit 530 may generate output signals that are provided to the transistors that control the amounts of the currents $I_{Green}$ and $I_{Amber}$ (which respectively correspond to the fluxes $Ø_G$ and $Ø_A$). The total current $I_T$ provided by the driver 522 may be used to scale the normalized parameters in the lookup table stored in the memory device 534 as can be readily understood by those of ordinary skill in the art with the benefit of this disclosure. In some alternative embodiments, the current sense circuit 520 may sense the current $I_{1500K}$ through the warm light LED 1002 instead of the current $I_{7000K}$, and the control circuit 530 may use the current information from the current sense circuit 520 to control the currents through the LEDs 1006, 1008 without departing from the scope of this disclosure.

In some example embodiments, the current provided by the driver 522 may depend on a dim level setting provided by the dimmer 540 in the same manner as described with respect to the lighting device 500 of FIG. 5. The control circuit 530 may receive the output of the current sense circuit 538 that indicates the total current $I_T$ and scale the values in the lookup table (e.g., Table 2) or the current information from the current sense circuit 520 accordingly to control current flows through the LEDs 1002-1108, which correspondingly controls the fluxes of the respective lights provided by the LEDs 1002-1008. For example, the dim level setting from the dimmer 540 may be provided to the control circuit 530, and the control circuit 530 may control the currents $I_{1500K}$, $N_{7000K}$, $I_{Green}$, and $I_{Amber}$ based on the current information from the current sense circuit 520 and the lookup table (e.g., the Table 2). In some alternative embodiments, the control circuit 530 may determine the dim level setting provided by the dimmer 540 based on the output of the current sense circuit 538 and the maximum total current $I_T$ that is provided by the driver 522 (e.g., known based on the specification or the configuration of the driver 522).

In some example embodiments, the control circuit 530 may control the fluxes of the lights provided by the LEDs 1002-1008 based on the dim level setting provided by the dimmer 540, where, for example, CCT setting is not provided to the control circuit 530. Table 3 below shows an example lookup table that includes dim level setting values and corresponding flux values for $Ø_{1500K}$, $Ø_{7000K}$, $Ø_G$, and $Ø_A$. The control circuit 530 may scale the flux values in Table 3 or the current information from the current sense circuit 520 according to the total current $I_T$ to control current flows through the LEDs 1002-1108 at each dim level setting value.

By using both the green light and the amber light and by adjusting their fluxes based on the relationship between the warm light and the cool light (as represented by the equations provided above), a white light tuning curve that closely matches the BBC 802 may be achieved when the CCTs of the warm light and the cool light are too far apart to adequately respond to a correction based on a single light (e.g., the green light).

In some alternative embodiments, the control circuit 530 may be integrated in the driver 522 without departing from the scope of this disclosure. In some alternative embodiments, the dimmer 540 (when present) and the user control device 536 (when present) may be integrated into a single device without departing from the scope of this disclosure.

TABLE 3

| Dimming | Ø1500K | Ø7000K | Øcorrection | ØG | ØA |
|---|---|---|---|---|---|
| 0% | 0.0000 | 0.0000 | 0.0000 | 0.0000 | 0.0000 |
| 2% | 0.0164 | 0.0003 | 0.0038 | 0.0001 | 0.0038 |
| 4% | 0.0321 | 0.0013 | 0.0154 | 0.0006 | 0.0148 |
| 6% | 0.0471 | 0.0030 | 0.0315 | 0.0019 | 0.0296 |
| 8% | 0.0615 | 0.0053 | 0.0505 | 0.0040 | 0.0464 |

TABLE 3-continued

| Dimming | Ø1500K | Ø7000K | Øcorrection | ØG | ØA |
|---|---|---|---|---|---|
| 10% | 0.0752 | 0.0084 | 0.0736 | 0.0074 | 0.0662 |
| 12% | 0.0882 | 0.0120 | 0.1005 | 0.0121 | 0.0884 |
| 14% | 0.1006 | 0.0164 | 0.1281 | 0.0179 | 0.1102 |
| 16% | 0.1123 | 0.0214 | 0.1573 | 0.0252 | 0.1321 |
| 18% | 0.1233 | 0.0271 | 0.1871 | 0.0337 | 0.1534 |
| 20% | 0.1336 | 0.0334 | 0.2166 | 0.0433 | 0.1733 |
| 22% | 0.1433 | 0.0404 | 0.2466 | 0.0543 | 0.1923 |
| 24% | 0.1523 | 0.0481 | 0.2751 | 0.0660 | 0.2090 |
| 26% | 0.1607 | 0.0565 | 0.3028 | 0.0787 | 0.2241 |
| 28% | 0.1684 | 0.0655 | 0.3282 | 0.0919 | 0.2363 |
| 30% | 0.1754 | 0.0752 | 0.3533 | 0.1060 | 0.2473 |
| 32% | 0.1817 | 0.0855 | 0.3764 | 0.1205 | 0.2560 |
| 34% | 0.1874 | 0.0965 | 0.3974 | 0.1351 | 0.2623 |
| 36% | 0.1924 | 0.1082 | 0.4162 | 0.1498 | 0.2664 |
| 38% | 0.1968 | 0.1206 | 0.4333 | 0.1646 | 0.2686 |
| 40% | 0.2004 | 0.1336 | 0.4478 | 0.1791 | 0.2687 |
| 42% | 0.2035 | 0.1473 | 0.4604 | 0.1933 | 0.2670 |
| 44% | 0.2058 | 0.1617 | 0.4707 | 0.2071 | 0.2636 |
| 46% | 0.2075 | 0.1767 | 0.4787 | 0.2202 | 0.2585 |
| 48% | 0.2085 | 0.1924 | 0.4846 | 0.2326 | 0.2520 |
| 50% | 0.2088 | 0.2088 | 0.4883 | 0.2442 | 0.2442 |
| 52% | 0.2085 | 0.2258 | 0.4899 | 0.2547 | 0.2351 |
| 54% | 0.2075 | 0.2435 | 0.4894 | 0.2643 | 0.2251 |
| 56% | 0.2058 | 0.2619 | 0.4868 | 0.2726 | 0.2142 |
| 58% | 0.2035 | 0.2810 | 0.4822 | 0.2797 | 0.2025 |
| 60% | 0.2004 | 0.3007 | 0.4756 | 0.2854 | 0.1903 |
| 62% | 0.1968 | 0.3211 | 0.4671 | 0.2896 | 0.1775 |
| 64% | 0.1924 | 0.3421 | 0.4569 | 0.2924 | 0.1645 |
| 66% | 0.1874 | 0.3638 | 0.4448 | 0.2936 | 0.1512 |
| 68% | 0.1817 | 0.3862 | 0.4303 | 0.2926 | 0.1377 |
| 70% | 0.1754 | 0.4093 | 0.4154 | 0.2907 | 0.1246 |
| 72% | 0.1684 | 0.4330 | 0.3981 | 0.2867 | 0.1115 |
| 74% | 0.1607 | 0.4574 | 0.3796 | 0.2809 | 0.0987 |
| 76% | 0.1523 | 0.4824 | 0.3592 | 0.2730 | 0.0862 |
| 78% | 0.1433 | 0.5081 | 0.3373 | 0.2631 | 0.0742 |
| 80% | 0.1336 | 0.5345 | 0.3139 | 0.2511 | 0.0628 |
| 82% | 0.1233 | 0.5616 | 0.2891 | 0.2370 | 0.0520 |
| 84% | 0.1123 | 0.5893 | 0.2628 | 0.2208 | 0.0421 |
| 86% | 0.1006 | 0.6177 | 0.2351 | 0.2022 | 0.0329 |
| 88% | 0.0882 | 0.6468 | 0.2058 | 0.1811 | 0.0247 |
| 90% | 0.0752 | 0.6765 | 0.1754 | 0.1578 | 0.0175 |
| 92% | 0.0615 | 0.7069 | 0.1433 | 0.1319 | 0.0115 |
| 94% | 0.0471 | 0.7380 | 0.1099 | 0.1033 | 0.0066 |
| 96% | 0.0321 | 0.7697 | 0.0749 | 0.0719 | 0.0030 |
| 98% | 0.0164 | 0.8021 | 0.0383 | 0.0375 | 0.0008 |
| 100% | 0.0000 | 0.8352 | 0.0000 | 0.0000 | 0.0000 |

Figure 11:
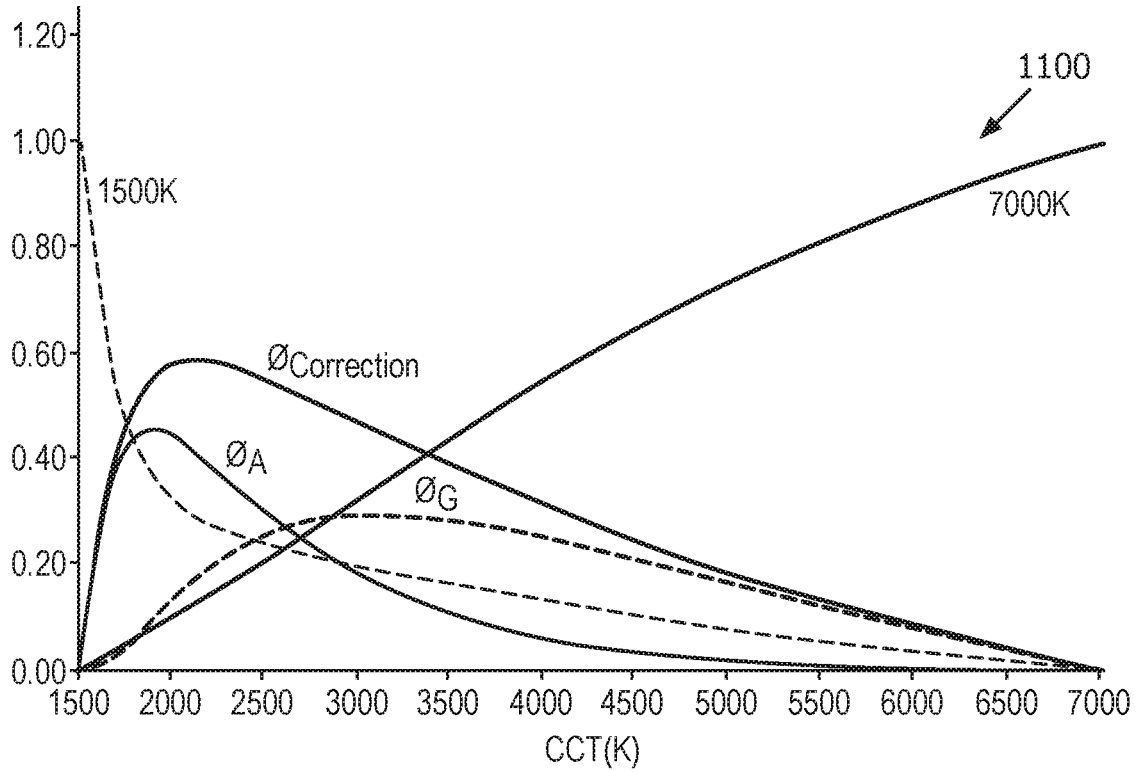
FIG. 11 illustrates a graph showing values of fluxes of a green light, an amber light, a cool light, and a warm light with respect to CCT setting values shown in the horizontal axis according to an example embodiment.

FIG. 11 illustrates a graph 1100 showing values of fluxes of a green light, an amber light, a cool light, and a warm light with respect to CCT setting values shown in the horizontal axis according to an example embodiment. For example, the values in Table 2 may be represented by corresponding points in the graph 1100.

Figure 12:
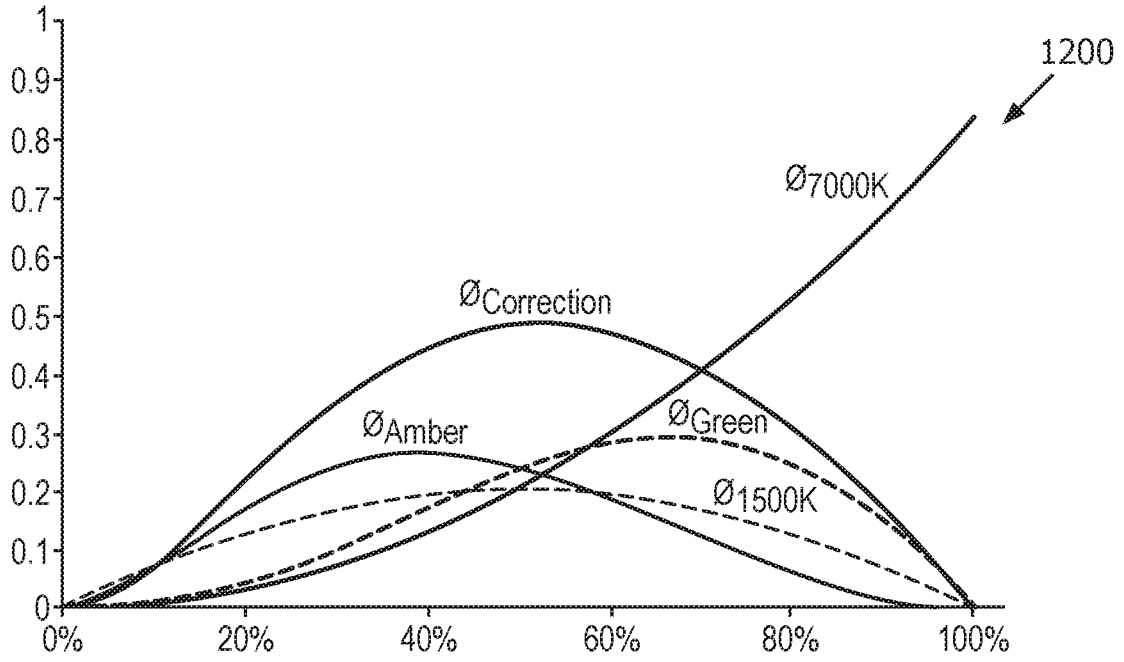
FIG. 12 illustrates a graph showing values of fluxes of a green light, an amber light, a cool light, and a warm light with respect to dim level setting values shown in the horizontal axis according to an example embodiment.

FIG. 12 illustrates a graph 1200 showing values of fluxes of a green light, an amber light, a cool light, and a warm light with respect to dim level setting values shown in the horizontal axis according to an example embodiment. For example, the values in Table 3 may be represented by corresponding points in the graph 1200, where 0% corresponds to total dimming and 100% corresponds to no dimming.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A lighting device, comprising:

a first string of light emitting diodes (LEDs) configured to emit a warm white light having a warm Correlated Color Temperature (CCT);

a second string of LEDs configured to emit a cool white light having a cool CCT; and green light LEDs that emit a green light, wherein a flux of the green light is controlled based on a flux of the cool white light or a flux of the warm white light, wherein the flux of the warm white light and the flux of the cool white light change proportionally with respect to each other, wherein the flux of the green light is controlled based on a lookup table that includes cool light flux values associated with green light flux values corresponding to the flux of the green light, and wherein the cool light flux values correspond to the flux of the cool white light.

2. The lighting device of claim 1, wherein the green light flux values are generated based on a second degree equation that approximates a black-body radiation curve.

3. The lighting device of claim 2, wherein a white light tuning path of an illumination light provided by the lighting device matches the black-body radiation curve and wherein the illumination light comprises the warm white light, the cool white light, and the green light.

4. The lighting device of claim 2, wherein the second degree equation is an equation of a parabola.

5. The lighting device of claim 1, wherein the lookup table includes warm light flux values associated with the green light flux values corresponding to the flux of the green light and wherein the warm light flux values correspond to the flux of the warm white light.

6. The lighting device of claim 1, wherein the cool CCT is approximately 6500K and wherein the warm CCT is approximately 2700K.

7. The lighting device of claim 1, further comprising a control circuit configured to control the flux of the green light.

8. The lighting device of claim 7, wherein the control circuit comprises an analog multiplier that provides an output to control the flux of the green light based on a current flowing through the second string of LEDs corresponding to the flux of the cool white light.

9. A non-transitory computer-readable medium containing instructions executable by a processor, the instructions comprising:

receiving information indicating an amount of a current flow through cool light LEDs that emit a cool white light; and generating an output signal to control a flux of a green light emitted by green light LEDs, wherein an illumination light provided by a light source comprises the cool white light, the green light, and a warm white light emitted by warm light LEDs, wherein the output signal is generated based on a lookup table that includes mappings of values of the cool white light corresponding to amounts of the current flowing through the cool light LEDs to values of the flux of the green light, and wherein the values of the flux of the green light are generated based on a second degree equation that is an approximation of a black-body radiation curve.

10. The non-transitory computer-readable medium of claim 9, wherein a white light tuning path of the illumination light matches the black-body radiation curve.

11. The non-transitory computer-readable medium of claim 9, wherein the second degree equation is an equation of a parabola.

12. The non-transitory computer-readable medium of claim 9, wherein the cool CCT is approximately 6500K and wherein the warm CCT is approximately 2700K.

13. The non-transitory computer-readable medium of claim 9, wherein the illumination light provided by the light source further comprises an amber light.

14. A lighting device, comprising:

a first string of light emitting diodes (LEDs) configured to emit a warm white light having a warm Correlated Color Temperature (CCT);

a second string of LEDs configured to emit a cool white light having a cool CCT;

green light LEDs configured to emit a green light; and amber light LEDs configured to emit an amber light, wherein a flux of the green light and a flux of the amber light are controlled based on a flux of the cool white light and wherein a flux of the warm white light and the flux of the cool white light change proportionally with respect to each other.

15. The lighting device of claim 14, wherein the flux of the green light and the flux of the amber light are controlled based on a lookup table that includes cool light flux values associated with green light flux values corresponding to the flux of the green light and associated with amber light flux values corresponding to the flux of the amber light and wherein the cool light flux values correspond to the flux of the cool white light.

16. The lighting device of claim 15, further comprising a control circuit configured to control the flux of the green light and the flux of the amber light based on a current flowing through the second string of LEDs, wherein the current flowing through the second string of LEDs corresponds to the flux of the cool white light.

17. The lighting device of claim 15, wherein the green light flux values and the amber light flux values in the lookup table are generated based on a proportion the cool light flux values to warm light flux values corresponding to the flux of the warm white light.

18. The lighting device of claim 14, wherein the cool CCT is approximately 7000K and wherein the warm CCT is approximately 1500K.

19. The lighting device of claim 14, wherein the cool CCT is approximately 7000K and wherein the warm CCT is approximately 1500K.

* * * * *